US006661352B2

(12) United States Patent
Tiernay et al.

(10) Patent No.: US 6,661,352 B2
(45) Date of Patent: Dec. 9, 2003

(54) METHOD AND MEANS FOR RF TOLL COLLECTION

(75) Inventors: Robert Walter Tiernay, Mississauga (CA); Thua Van Ho, Mississauga (CA); Weimin He, Mississauga (CA); James Kenneth Cook, Mississauga (CA); Mohammed Benvidi, Mississauga (CA)

(73) Assignee: Mark IV Industries Limited, Mississauga (CA)

( * ) Notice: Subject to any disclaimer, the term of this patent is extended or adjusted under 35 U.S.C. 154(b) by 0 days.

(21) Appl. No.: 10/060,092

(22) Filed: Jan. 31, 2002

(65) Prior Publication Data

US 2003/0001755 A1 Jan. 2, 2003

Related U.S. Application Data

(63) Continuation of application No. 09/371,863, filed on Aug. 11, 1999, now abandoned.

(51) Int. Cl.[7] ..... G08G 1/065
(52) U.S. Cl. ..... 340/928; 235/384
(58) Field of Search ..... 340/928, 933, 340/937; 235/384; 380/23, 29; 342/44; 705/13

(56) References Cited

U.S. PATENT DOCUMENTS

| | | | | | |
|---|---|---|---|---|---|
| 4,104,630 | A | * | 8/1978 | Chasek | 342/44 |
| 4,303,904 | A | * | 12/1981 | Chasek | 235/384 |
| 4,870,419 | A | * | 9/1989 | Baldwin et al. | 342/50 |
| 4,937,581 | A | * | 6/1990 | Baldwin et al. | 340/10.52 |
| 5,086,389 | A | | 2/1992 | Hassett et al. | |
| 5,132,687 | A | * | 7/1992 | Baldwin et al. | 342/44 |
| 5,144,553 | A | | 9/1992 | Hassett et al. | |
| 5,164,732 | A | * | 11/1992 | Brockelsby et al. | 342/44 |
| 5,196,846 | A | * | 3/1993 | Brockelsby et al. | 340/10.51 |
| 5,253,162 | A | | 10/1993 | Hassett et al. | |
| 5,289,183 | A | * | 2/1994 | Hassett et al. | 340/905 |
| 5,310,999 | A | * | 5/1994 | Claus et al. | 235/384 |
| 5,424,727 | A | | 6/1995 | Shieh | |
| 5,425,032 | A | * | 6/1995 | Shloss et al. | 370/346 |
| 5,485,520 | A | | 1/1996 | Chaum et al. | |
| 5,602,375 | A | | 2/1997 | Sunahara et al. | |
| 5,640,156 | A | * | 6/1997 | Okuda et al. | 340/928 |
| 5,657,008 | A | | 8/1997 | Bantli | |
| 5,675,342 | A | | 10/1997 | Sharpe | |
| 5,701,127 | A | | 12/1997 | Sharpe | |
| 5,751,973 | A | * | 5/1998 | Hassett | 705/13 |
| 5,777,565 | A | * | 7/1998 | Hayashi et al. | 340/928 |
| 5,805,082 | A | * | 9/1998 | Hassett | 340/928 |
| 5,819,234 | A | | 10/1998 | Slavin et al. | |
| 5,831,547 | A | | 11/1998 | Ohtsuki et al. | |
| 5,841,866 | A | | 11/1998 | Bruwer et al. | |
| 5,850,191 | A | * | 12/1998 | Yagi et al. | 340/928 |
| 5,857,152 | A | | 1/1999 | Everett | |
| 5,859,415 | A | | 1/1999 | Blomqvist et al. | |

FOREIGN PATENT DOCUMENTS

| | | |
|---|---|---|
| EP | 0333679 | 9/1989 |
| JP | 8307931 | 11/1996 |
| JP | 10105753 | 4/1998 |
| WO | 9933027 | 1/1999 |

* cited by examiner

*Primary Examiner*—Nina Tong
(74) *Attorney, Agent, or Firm*—Dowell & Dowell P.C.

(57) ABSTRACT

An RF roadway toll collection system uses an upstream reader to communicate with a vehicle borne transponder carrying a Smart Card to calculate the toll and debit the Smart Card balance in the amount of the toll payment required. A transaction manager is notified of the toll payment from the upstream reader and notifies a downstream reader of the vehicle identification and payment status. The downstream reader confirms the vehicle identification and payment status and signals if the toll has been paid.

23 Claims, 6 Drawing Sheets

METHOD AND MEANS FOR RF TOLL COLLECTION

This is a continuation application of U.S. Ser. No. 09/371,863 filed Aug. 11, 1999 which is now abandoned.

FIELD OF THE INVENTION

The invention relates to the field of RF toll collection wherein, in a roadway environment, vehicle borne transponders communicate with a stationary reader or readers to establish the toll for the vehicle carrying the transponder.

BACKGROUND OF THE ART

Patents relating to such field include:

U.S. Pat. No. 4,104,630 August 1978 Chasek

U.S. Pat. No. 4,303,904 Dec. 1, 1981 Chasek

U.S. Pat. No. 4,870,419 Sep. 26, 1989Baldwin et al

U.S. Pat. No. 4,937,581 Jun. 26, 1990 Baldwin et al

U.S. Pat. No. 5,132,687 Jul. 21, 1992 Baldwin et al

U.S. Pat. No. 5,164,732 Nov. 17, 1992 Brockelsby et al

U.S. Pat. No. 5,192,954 Mar. 9, 1993 Brockelsby et al

U.S. Pat. No. 5,196,846 Mar. 23, 1993 Brockelsby et al

U.S. Pat. No. 5,289,183 Feb. 22, 1994 Hassett et al

DISCLOSURE OF THE INVENTION

For conventions herein, the traffic flow eastbound and from left to right in the drawings may be thought of as representative of all directions.

Toll Plaza is the name for the toll collection point.

Electronic Toll Collection may be shortened to 'ETC'.

By 'transaction manager' is meant a device for coordinating an upstream and a downstream reader, toll processing calculator, and locator.

'Point of Entry' data or ETC data; includes sufficient information to calculate the toll charge and usually includes: point of entry, toll plaza ID, vehicle class and transponder ID.

A wide area is an area materially wider than the width required by a lane for a roadway vehicle hence a wide area roadway is materially wider than a single lane highway.

A wide area reader is typically used for a wide area RF communication system incidental to toll collection. The wide area capture zone is typically 16.8 meters (55 feet) wide by 36.6 meters (120 feet) long. The wide area reader typically uses a protocol known as Time Division Multiple Access (TDMA).

A lane based reader controls reader channels, each one of which corresponds to an individual vehicle lane which will communicate with a vehicle in an individual lane. A lane communication capture zone is typically 1.2 to 2.4 meters (4–8 feet) long and 3 meters (10 feet) wide. A vehicle in a lane capture zone may be uniquely identified.

Time Division Multiple Access (TDMA) is the preferred communications protocol in the upstream capture zone.

A conventional TDMA frame consists of a header known as a Frame Control Message (FCM), four data slots and sixteen activation slots of the type known as slotted Aloha. The FCM directs up to four transponders individually to transmit or receive in the four data slots. The activation slots are shared by all transponders on a random access basis to allow the transponder to notify the reader of its presence. A TDMA frame is approximately 10 ms long.

In this development it is preferred to extend the conventional TDMA protocol, to include optional new added fields desirable for communicating with a Smart Card toll system and at the same time maintain compatibility with the conventional TDMA system.

The preferred added fields may include:

Application Identifier Field—This field is used to inform the transponder which application is running in the reader, so that upon wake up, the transponder can initialize the on board device accordingly. Under the development, as described herein, the reader will only operate in accord with the first or wide area protocol. However, other applications, not part of the toll collection system described, may be added at another time.

Frame Number Field—This field is used by the transponder for antenna tracking and switching.

Antenna Number Field—This field is used by the transponder for antenna tracking.

Antenna Tracking and Switching Control—This field is used by the transponder to select the antenna tracking and antenna switching so that it can be dynamically controlled by the reader.

Media Request Activation Control Field (MRA)—This field is used by the reader to command the transponder whether to transmit an MRA after the required process is completed.

Protocol Control Field—This field is used by the reader to command the transponder to go to sleep mode or to switch to lane based protocol after the first protocol is complete.

The added fields maybe arranged in any order in their position at the start of the FCM frame.

The TDMA system with the added fields is referred to herein as 'extended TDMA'.

'Superframe'; In the system preferred herein there are four TDMA (preferably extended) RF channels. A superframe is a complete cycle of the four channels by the TDMA Reader with one frame being cyclically transmitted on each antenna. A superframe for four channels is approximately 40 ms in duration.

'ID'; means 'Identification'.

'Tag'; is sometime used herein as a synonym for transponder.

'Upstream' and 'Downstream'; herein relate to position relative to traffic flow. Vehicles move from an upstream position to a downstream position.

A reader is a stationary transmitter receiver which enters into RF communications protocol with a vehicle borne transponder. The preferred embodiment uses a wide area reader which, upstream, enters into a first communication protocol with a vehicle borne transponder and a second or lane based reader which downstream, provides a plurality of channels each for an individual lane, one of which enters into a second protocol with the same transponder.

A principal variant of the invention uses, for RF communication, a transponder equipped with a Smart Card which may be electronically and mechanically coupled thereto, usually being optionally detachable. This variant as well as the description as a whole relates to the methods of using the Smart Card. The Smart Card equipped transponder is used in a roadway environment having a first reader defining an upstream RF communication or 'capture' zone designed to communicate with vehicle borne transponders over a roadway area wider than a single lane, to obtain from the transponder information for a transaction manager allowing the calculations as to toll amount and payment status. The data thus obtained is associated with the transponder ID and a second lane based downstream reader is connected to receive by downstream RF communication the status of payment and transponder ID.

The lane based readers are designed to define downstream communications zones designed to associate the transponder ID and payment status uniquely with vehicle travelling in an individual lane. Preferably the lane based reader is connected to a lane controller which directs the vehicle carrying the subject transponder to stop or go in accord with the payment status.

In a preferred variant of the invention the transponder provides the first reader with the information from the transponder and its Smart Card including the balance from which the toll may be deducted. This information is provided to calculating and coordinating means, here called a transaction manager, which calculates the toll and directs the Smart Card via the first reader and transponder to debit the toll amount and deduct it from the account balance. Then the Smart Card provides a completion message which includes: a payment status report, which may be 'paid'; 'insufficient balance' or another condition; a certificate of payment to the transaction manager; and a signature for the financial institution. The transaction manager is equipped to report the payment status independent of the transponder and Smart Card to the second reader which is adapted to deal individually with the vehicles and which will physically associate the status and vehicle ID with a vehicle then in an individual lane and customarily direct the vehicle with the subject transponder usually by means of light signals typically attached to a lane controller.

The process as described provides the required security of financial information and account balances unlike the prior art use of a single reader. The use of a transaction manager provides a communication path from the wide area reader communication zones to the lane based reader which parallels that of the vehicle borne transponder. The transaction manager also provides a highly fraud proof method of securely confirming a successful operation. In a preferred mode of ensuring the security of the transaction, described in detail hereafter, the Smart Card, on the successful completion of a toll transaction, after debiting the account balance, calculates a two part message (called a certificate of payment).

The transaction manager independently calculates the two part message. One part of the Smart Card originating version of the certificate of payment is sent to the transaction manager for comparison. The second part of the Smart Card version of the certificate of payment is sent to the downstream reader for comparison with the second part of the transaction manager originating message. If the two comparisons coincide the debit transaction has been complete. This is discussed in more detail hereafter.

A transponder may be equipped with visual aids such as red, green, blue and/or yellow light emitting diodes (LEDs) which may be ON or OFF or intermittent. A transponder may be equipped with a buzzer which maybe ON or OFF or intermittent. Such light or sound means are customarily actuable by a reader, to sensibly signal the vehicle operator.

In a preferred aspect of the invention, an extended version of the TDMA protocol is used at the wide area reader. A TDMA reader can communicate with up to four different transponders per frame, by placing up to four different transponders IDs in the Frame Control Message transmitted at the beginning of every frame. Interference is avoided by having the transponder examine the Frame Control Message, and only if it observes an ID matching its own, can a transponder receive or transmit data.

A channel is the path for a signal, including signals between a transponder and a reader. In this application, the first or wide area reader, preferably supports four channels each of which may have a number of antennas each of which communicates with a number of transponders in time separation mode. In this application, second or lane based readers preferably support a channel for each lane at the toll plaza. There are typically 10–20 lanes and up to 8 channels (and antennas) per lane based reader.

In a preferred arrangement, a number of first reader fixed antennas may be provided and these are synchronized so that no meaningful interference may occur between fixed antenna radiation. If a channel is transmitted by more than one antenna, the channel system is provided by an RF splitter with antennas carrying the same channel space as far apart as possible to provide a geographical separation between antennas broadcasting on the same channel.

In a preferred variant of the invention, the channels of the second readers, each typically providing a channel for each lane up to seven lanes, are synchronized with each other and with the first readers.

In a preferred embodiment of the invention all fixed readers transmit at a different frequency than the transponders so that transponder transmissions which tend to be much weaker than those from fixed transmitters are not interfered with.

In a preferred variant of the invention a frame based transmission is used at the first reader so that this provides contention resolution between transponders communicating with the same antenna. Preferably the frame based system used is the Time Division Multiple Access (TDMA) system known as the 'Slotted Aloha' and described in U.S. Pat. Nos. 5,425,032 and 5,307,349, both to Shloss et al.

In a preferred variant of the invention, multiple (here four) channels of the first reader are provided preferably broadcasting in cyclical sequence the TDMA or extended TDMA frames (such sequence defines a superframe). Thus the upstream first reader antennas may be spaced from each other so that, in the event that a channel is being broadcast from two antennas simultaneously, the antennas are geographically separated to avoid interference at a transponder.

Where multiple upstream antennas are used, these are preferably sought intermittently by a transponder. The transponder is preferably time synchronized to receive a selected antenna for communication while sampling a number of antennas, say four, for comparative quality of service, i.e. transmission and reception. An algorithm preferably provides control of a switch for changing antennas and to call for switching at any time from one antenna to an antenna whose quality of service is consistently highest.

The algorithm for antenna selection and switching shown hereafter contains, as shown, several features. The number of superframes whose frame reception numbers are to be compared is chosen. A threshold number limits the comparison to antennas whose frame are received above a selected frame minimum in the N superframes. A number is subtracted from an antenna's count for heavily loaded antennas. A hysteresis factor requires an unconnected candidate antenna to have a selected higher frame count than the connected antenna before being connected, to avoid too frequent switching.

In a preferred form of the invention a locator antenna system is provided. This may operate in accord with the system described in U.S. Pat. No. 6,025,799 issued to Ho et al., or U.S. Pat. No. 5,227,503 issued to O'Connor et al. Whatever the approach taken, the locator antenna system is used to determine, by triangulation and in terms of probability, whether the subject transponder (identified by its ID and coordinated by the transaction manager) is located inside the first (wide area or upstream) communications zone as opposed to being located outside the roadway associated with the subject capture zone or travelling the reverse direction.

In a preferred form of the invention, the locator provides probability thresholds; two of which are used for probability assessment. At a lower level (preferably 95% certain), it allows communication of the transponder information from the upstream reader to the transaction manager, and at a relatively higher certainty level (preferably 99.995%) it allows the debit transaction to be completed and acknowledged between the upstream reader and the transponder and Smart Card.

BRIEF DESCRIPTION OF THE DRAWINGS

In drawings which illustrate a preferred embodiment of the invention.

MODE FOR CARRYING OUT THE INVENTION

Figure 1:
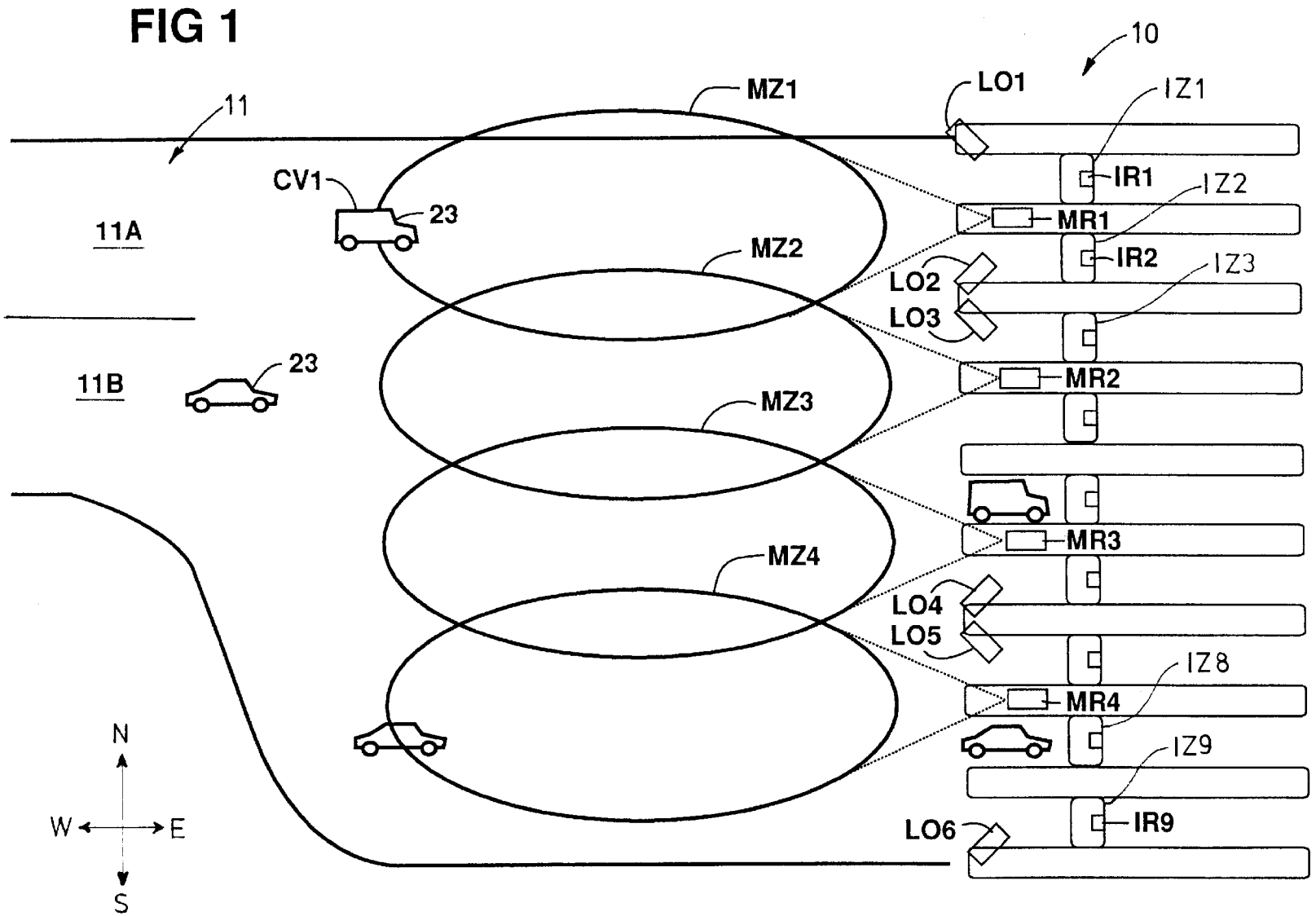
FIG. 1 is a schematic plan view indicating relative locations of the upstream (wide area) and downstream (lane based) capture zones, and of the wide area (first reader), lane based (second reader) and locator antennas.

In the drawings, and as shown in FIG. 1, a multilane roadway 11 contains a toll plaza 10. This application only discussed one direction of traffic flow, here eastbound, since other directions may be easily deduced.

As shown in FIG. 1, the eastbound section of a multilane roadway comprises two upstream lanes 11A and 11B, widening downstream to a number of individual lanes, as desired, it being understood that there must be enough of individual lanes to avoid a back up of traffic approaching from the multilane section.

Figure 2:
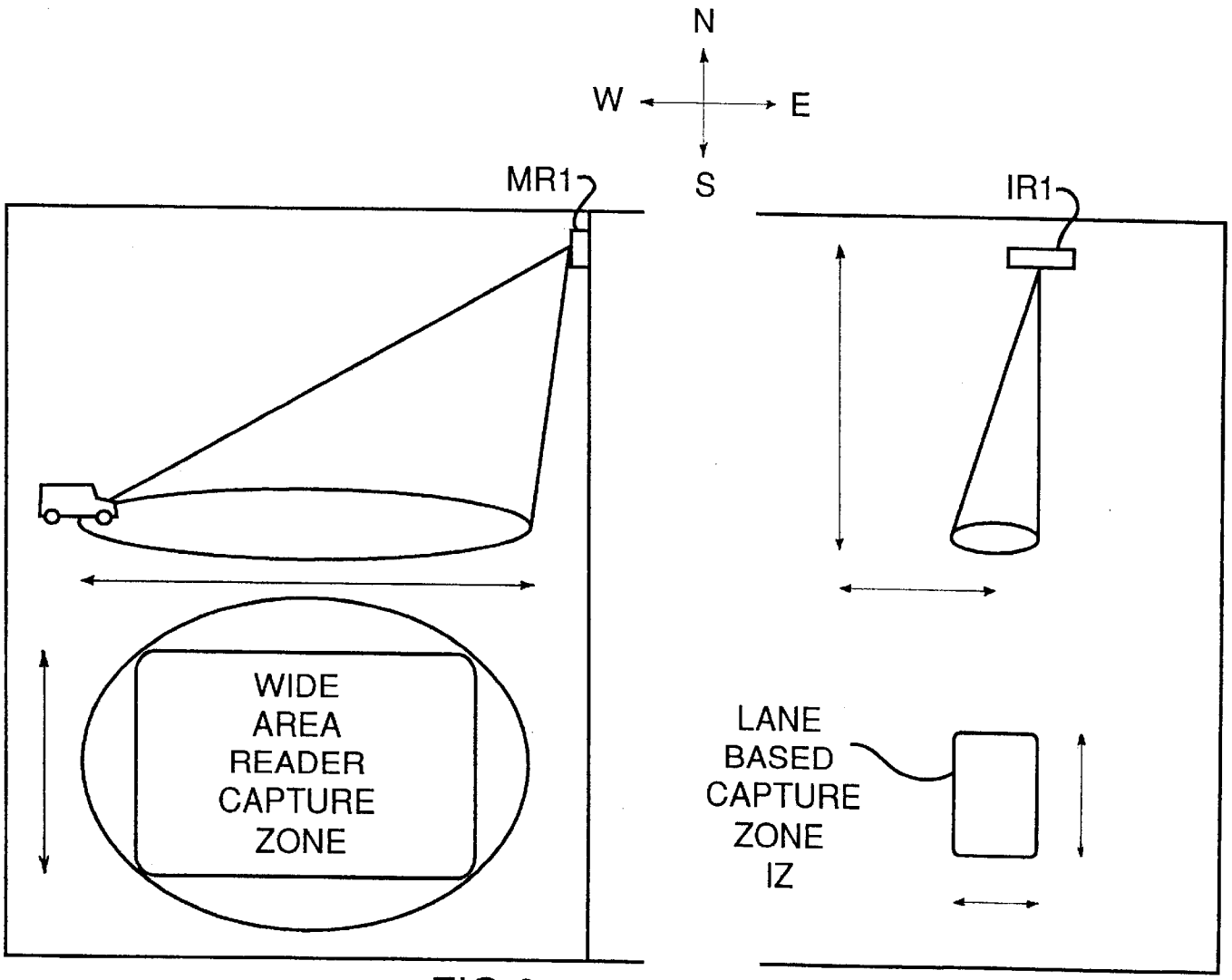
FIG. 2 is a composite schematic showing on the left, the side view (top) and 'footprint' (bottom) of a typical multilane or open road communications zone; and, on the right, the side view (top) and 'footprint' (bottom) of a typical individual lane or lane based communications zone.

Wide area communications or capture zones MZ1, MZ2 . . . MZ4 represent the individual lane areas where the antennas MR1, MR2 . . . MR4 communicate with vehicle transponders 23 in the wide area which includes lanes 11A and 11B. Downstream from the multilane capture zones MZ1, MZ2 . . . MZ4, are individual or lane based communication or capture zones IZ1–IZ9 for the lane based antennas IR1–IR9. Lane based antennas IR1–IR9 (each of which may be a separate channel of one of the downstream lane based readers) are provided for each individual lane. As seen best in FIG. 2, exemplary dimensions of a wide area or TDMA capture zone or 'footprint' for areas MZ1–MZ4 preferably includes an area about 16.8 meters (55 feet) wide and 36.6 meters (120 feet) long. The wide area capture zones must of course overlap to intercept all vehicles in the wide zone.

Locator antennas 30 in pairs: LO1 and LO2; LO3 and LO4; and LO5 and LO6 operate to locate (by triangulation) and allow the locating and tracking of a vehicle. Locator antennas north of LO1 and south of LO6 (not shown) may be provided if the upstream area requires further locator antenna pairs. The locator system may preferably operate in accord with the technique described in commonly owned U.S. Pat. No. 6,025,799 to Ho et al., or in accord with other systems such as that shown in U.S. Pat. No. 5,227,503 to O'Connor et al. Techniques such as that shown in U.S. Pat. No. 6,025,799 may be used to track the vehicle and use a technique whose probability of accuracy will steadily increase. Thus the locator may be used to ensure that the vehicle containing the transponder is on the multilane roadway and not in a vehicle, for example, going in the opposite direction or outside the multilane roadway. The locator may also be used to determine by probability of location in a capture zone when accurate communication may take place between the readers and vehicle transponder.

Most transponders encountered in the system being described will be equipped with Smart Cards. In the preferred system, the transponders without a Smart Card will be ignored by the wide area reader and communicate only with an antenna of the lane based reader. A Smart Card equipped transponder enters into a first protocol communication with the open road reader in the multilane section and later into a second protocol communication with an individual lane channel of a lane based reader.

The transponder 23 preferably carries its basic ETC information, comprising transponder ID, point of entry, toll plaza ID, time of entry, vehicle class, with or without a Smart Card. When a Smart Card is attached to the transponder there becomes available the Smart Card data necessary to complete a toll transaction or electronic payment, principally at the first reader, and to be verified at the second lane based reader as described hereafter.

The transponder at the first reader is designed, in the absence of a Smart Card, to have the transponder ignored by the wide area reader and so that the transponder communicates only the ETC information to a channel of the lane based reader in the individual lane used by the vehicle carrying the transponder.

Figure 6:
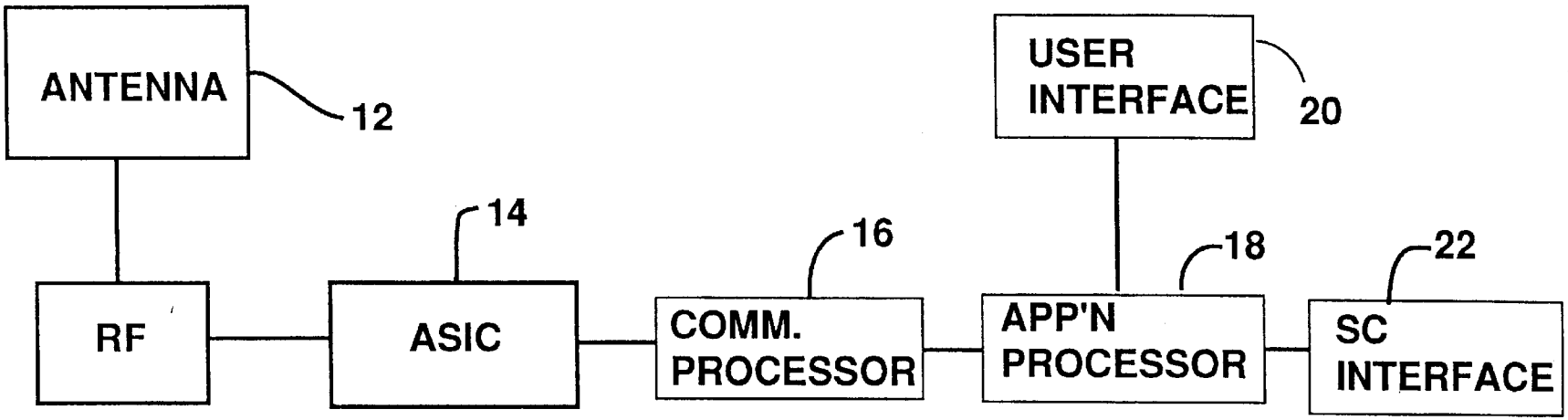
FIG. 6 is a schematic of a transponder component arrangement.

Preferred transponder components are shown in FIG. 6. Such a transponder has antenna 12 connected to the application specific integrated circuitry(ASIC) 14. The ASIC is also connected to the communications processor 16, and through it to application processor 18. The applications processor connects to the Smart Card interface 22 and to user interface 20. The user interface usually comprises three colours of LED and a buzzer (not shown). Each of the LED radiation or sounds may be OFF, ON or ON intermittently or flashing.

Typical information on a Smart Card includes:

Transaction state

Balance

Card Type

Card Command Status

Card Transaction Counter

Payment System ID

Key Version

Class Card

Card Serial Number

Purse ID

Card Version External Authorized Key ID

External Authorized Key ID where the Balance is the amount available to pay tolls and where the 'Purse ID' relates to the protocol (not here discussed) for the financial institution which receives credit for the debits from the card and the financial institutions which supply the funds to replenish the balance.

When a Smart Card is attached to a transponder they act collectively to communicate in accord with the first protocol with a TDMA reader 29 and thereafter in accord with the second protocol with one of the channels of a lane based reader. Without a Smart Card, with preferred first and second protocols the upstream reader 29 and the transponder will ignore each other.

The transponder will typically transmit at 915 MHz and receive at 918 MHz so that the transmissions of the transponders will not be confused or rendered incomprehensible by stronger reader transmissions.

Figure 5:
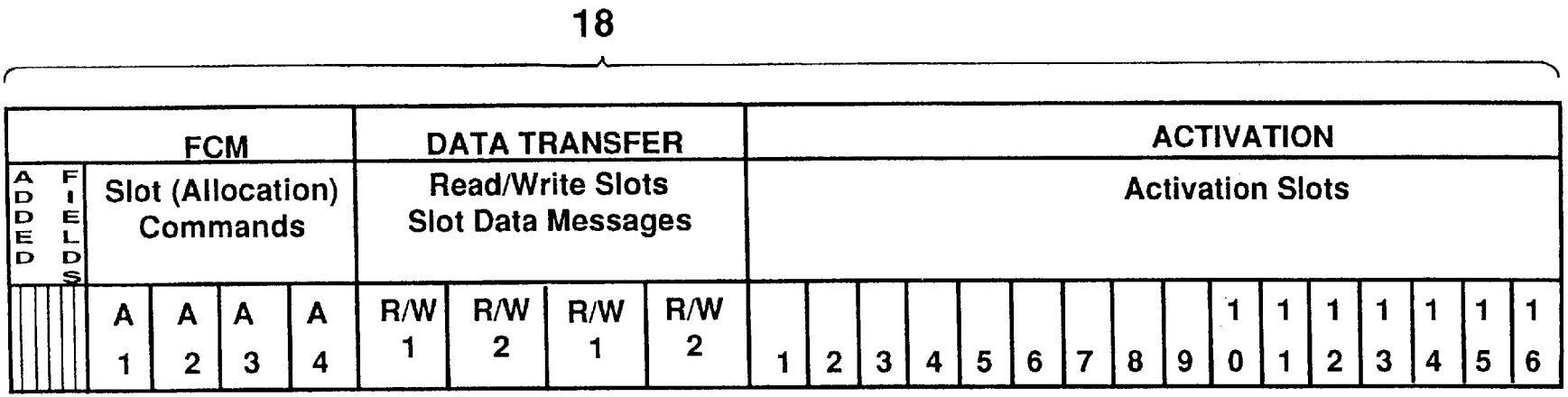
FIG. 5 is a chart of the preferred frame based RF TDMA communication protocol extended as previously discussed.

The TDMA system at the wide area reader gives time diversity as is well known to those ordinarily skilled in the art. As shown in FIG. 5, the preferred protocol is that the frame based transmission frame 18 is comprised of: a frame control message FCM (which may include added fields as discussed); a DATA TRANSFER section with four slots for slot data messages to and from transponders; and an ACTIVATION section of sixteen activations slots. Each reader antenna is programmed to transmit the extended TDMA frame continually (interleaved with other channels as described).

With reference particularly to FIG. 5, 'read' and 'write' are used from the aspect of the wide area reader so the 'read' means that the wide area reader is receiving data from the transponder, whereas 'write' means that the wide area reader is sending data to a transponder. Typically, although it does not fundamentally affect the operation, the protocol uses data transfer slots starting from the left for 'read' and starting from the right for 'write'.

It is preferred to use four RF channels, R/W1-R/W4. If there are more than four channels required to cover the span of the roadway at a wide toll plaza, every fourth antenna is connected to an RF splitter from the same channel, so that the antennas which are on the same channel are at maximum spacing. The same logic may be used if a different number of channels is used.

Figure 5A:
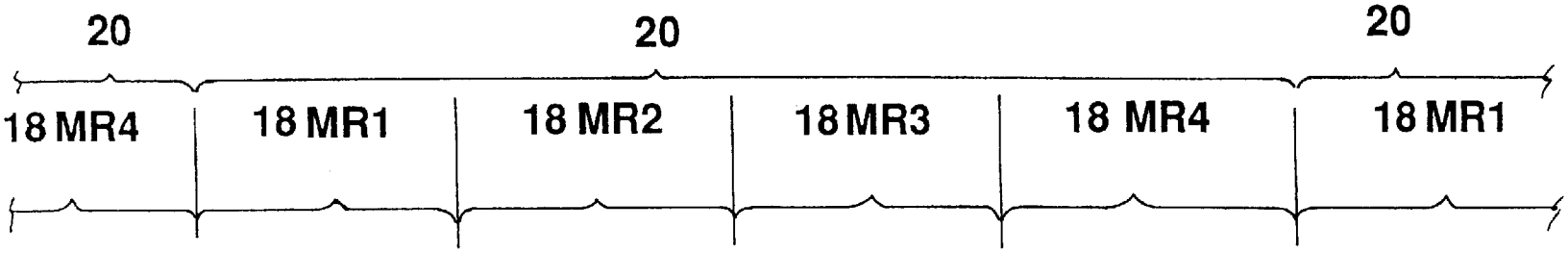
FIG. 5A shows the protocol of FIG. 5 combined in a superframe.

Thus the transmissions of the four channels are time separated within a superframe 20, see FIG. 5A. The transmission is preferably cyclical with the cycle continuous, identified by its place in the timed cycle. The transponder is programmed to contain an algorithm to select the antenna with the most consistent reception quality, and switch the antenna subject to parameters, as discussed further below.

The transponder is programmed to be activated at intervals, in one of which it may detect an FCM. On detection, the transponder may make a request for access to the system. In doing so the transponder picks one of the sixteen activation slots, at random, to avoid the likelihood that two transponders will transmit in the same slot. If two transponders choose the same activation slot, the effect of their superimposed signals causes them to be ignored (as a valid message) by the reader, so that each transponder must (again at random) act to gain entry to the first protocol communication. Three of the usual signals sent by a transponder in the activation slot(accompanied by its ID) are:

NEA-Net Entry Activation Request—used by the tag as the normal way to indicate that it is ready to transmit its memory contents.

MRA-Media Request Activation Request—used by the tag to request Data Transfer Slot.

ASA-Antenna Switch Activation Request—used by the tag to indicate that it wishes to communicate through a different antenna MR1–MR4.

Acceding to this request will cause the reader to assign a data transfer slot in a different frame of the superframe.

As a vehicle, such as CV1 in FIG. 1, enters capture zone MZ1, the upstream reader, say on channel MR1, signals the transponder in CV1 in response to its NEA request (which in the first protocol as preferred, will only be received if the transponder has a Smart Card inserted), by assigning a data transfer slot say R/W1 via which the Smart Card transponder 23 may send on MR1 the initial Smart Card data.

The initial Smart Card data includes; the balance on the Smart Card, transponder ID, Point of Entry and Vehicle Class.

The data from the Smart Card transponder 23 (which has a Smart Card inserted) is sent to the wide area reader 29 in the assigned data slot R/W1. The reader 29 (which is in communication with the locator 30) temporarily holds data received by the Smart Card until the locator 30 indicates a (say 95%) certainty that the transponder is in one of the wide area zones, indicated by MZ1–MZ4, rather than outside or on a reverse course. When this 95% threshold is reached, the Smart Card data is transmitted from the reader 29 to the transaction manager 24 so that the transaction manager 24 may begin its portion of the secure transaction process. The transaction manager uses the data received, to calculate the debit for the toll and determine whether or not it is covered by the balance currently on the card. The transaction manager 24 returns to reader 29 a set of instructions destined for the Smart Card in the Smart Card transponder 23. This data is to be delivered to the transponder 23 by the reader 29 when the reader receives assurance from the locator 30 that a second threshold of certainty, (say 99.995%) is indicated that the transponder 23 is within one of the zones. When this is the case, the reader assigns a data slot to the transponder 23 and initiates transmission of the sequence of instructions encoded therein. These instructions, which are executed by the transponder, indicate that a debit is to be performed, or, if the balance is insufficient that the Smart Card should be turned off. Upon completion of the transaction with the Smart Card, if a debit were performed, the Smart Card transponder 23 initiates a sequence to signal the reader 29: (1) that the return information required by the transaction manager 24 to complete the secure transaction (a certificate of payment and a signature) is available; or (2) that the toll was not paid due to low balance or an incomplete transaction. The transponder 23 requests, via a MRA, a data slot via which it may return the data. The reader 29, in recognition of this signal, assigns a data slot to perform the read. Upon receipt of the data (certificate of payment and the signature, on the one hand, or the toll unpaid status, on the other hand), the reader 29 passes the data directly to the transaction manager 24 to complete the debit transaction.

When the wide area (first protocol) transaction has been complete between the transaction manager 24 and a Smart Card transponder 23, the transaction manager will inform all lane based readers 34 of the payment status of the subject transponder Smart Card and of its ID.

Thus when the vehicle borne Smart Card transponder 23 arrives at one of the lane based capture zones IZ1 to IZ9 and enters into communication under the second protocol with one of the lane based readers, and on receipt of the transponder ID, it is determined whether the toll transaction was successful or not. The lane based reader 34 then signals the associated lane controller 36 to appropriately direct the vehicle, i.e., for a successful transaction to give a green light, have the associate lane controller lift barriers or otherwise to process the vehicle out to the toll plaza or (for an unsuccessful transaction) to show a red light or put a barrier in place or indicate an appropriate lane, and in either event, to purge the transponder from the list now that its status is identified with a particular vehicle. Further status alternatives, 'card withdrawn', 'bad card', and 'transponder not in toll plaza' may be provided.

Figure 3:
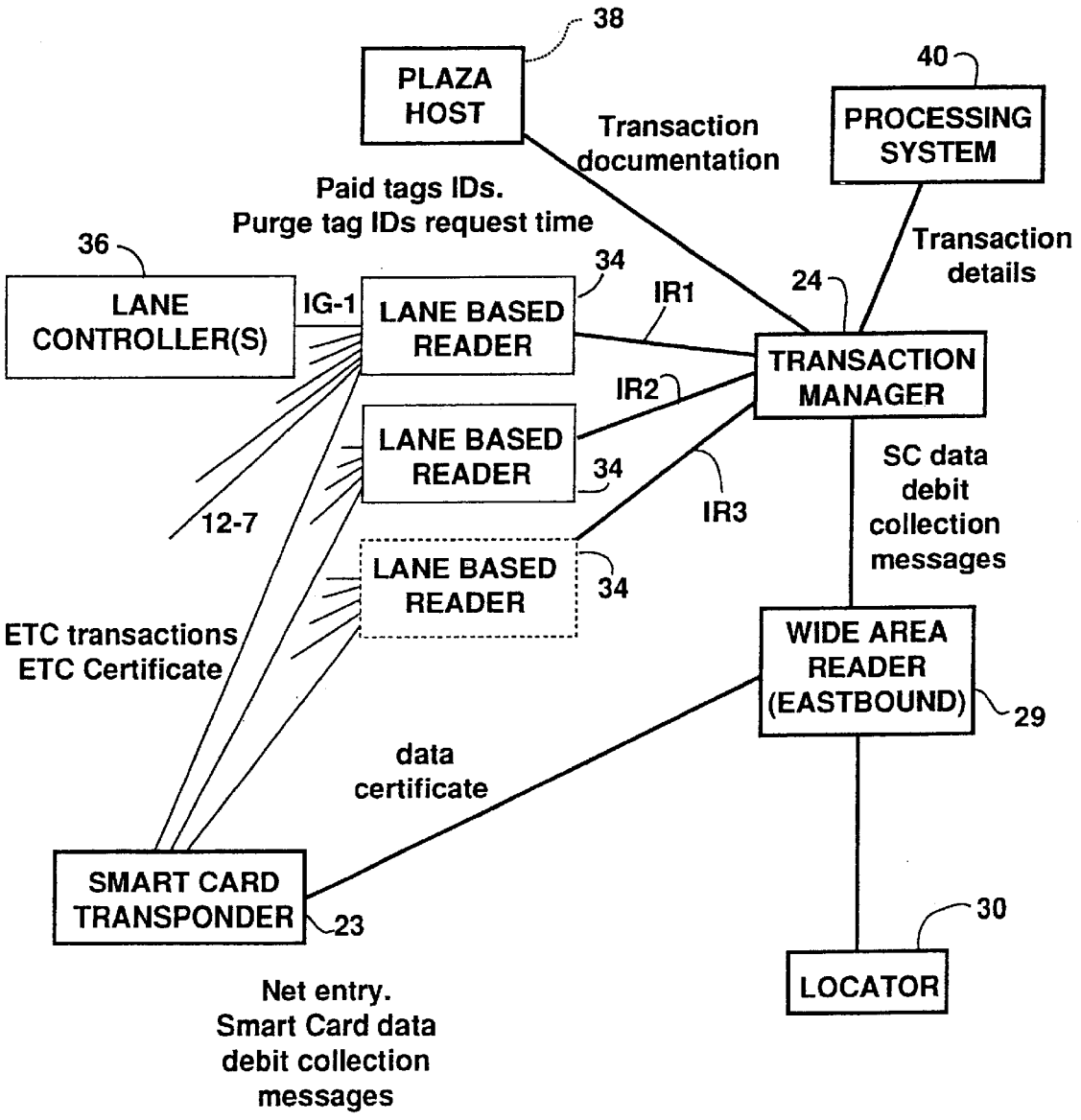
FIG. 3 is a schematic view showing the relationship of the major system components.
Figure 4:
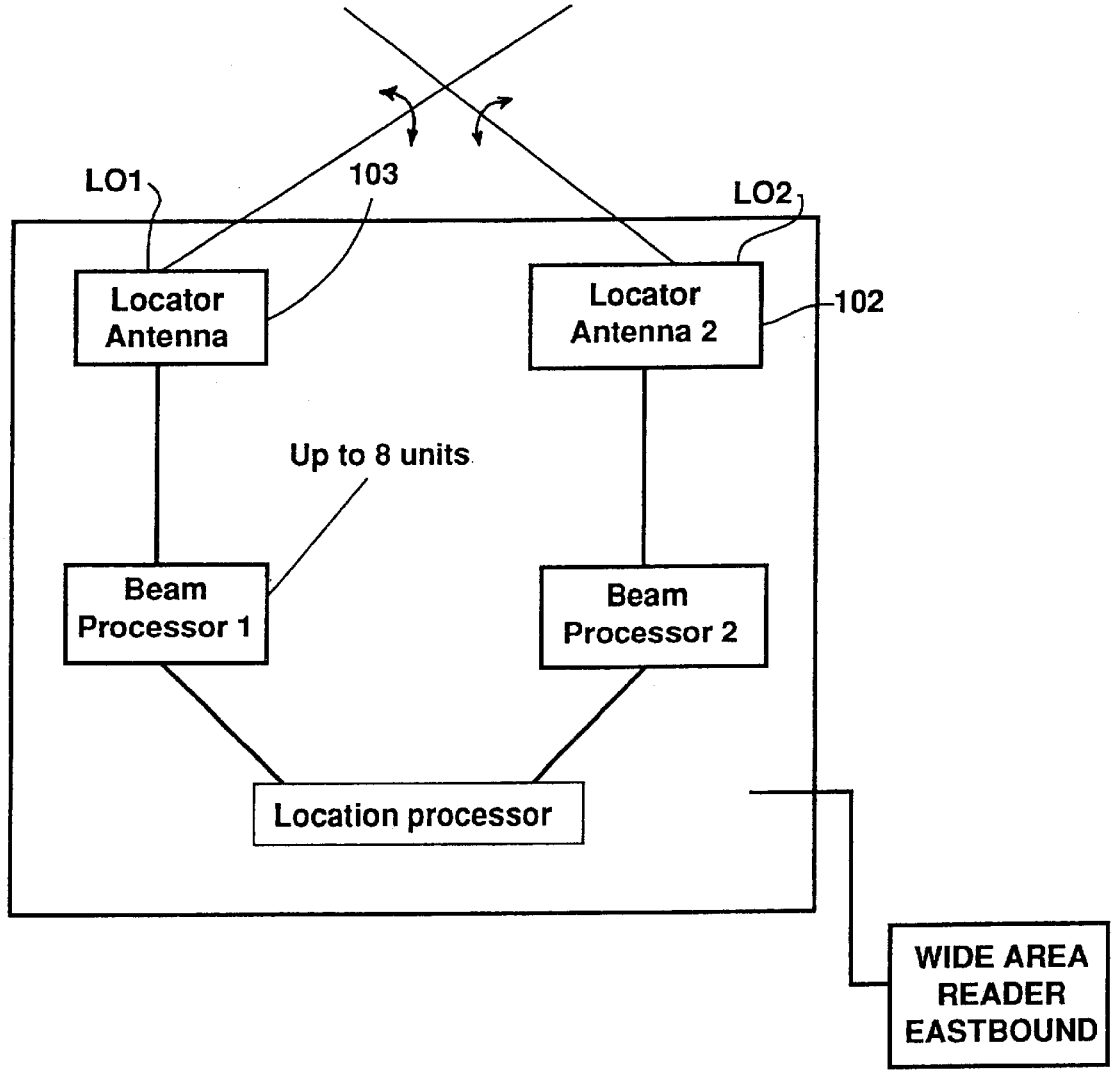
FIG. 4 is a schematic view of a locator system.

FIG. 3 shows schematically the overall system. Before describing the operation it will be noted that the plaza host 38 has numerous duties including keeping records for the processing system 40 which operates as a calculator for the transaction manager 24.

In operation, referring to FIGS. 3 and 6, the Smart Card Transponder 23 is in wide area mode to communicate under a first protocol with the wide area reader 29 or in lane based mode, to communicate under a second protocol with one of the channels of a lane based reader 34.

The current Smart Card balance is read and stored on the Smart Card transponder upon insertion of the Smart Card or after each transaction. The tag is designed to self energize at intervals to sample for RF data streams. When the tag detects such a data stream, the communication processor 16 is energized and thereafter the application processor 18 is energized.

The wide area reader 29 is energized continually. When the frame control message from one of the frames of the superframe is received, the Smart Card transponder activates on the best antenna(i.e. provider of the best frame MZ1–MZ4 after N superframes). The transponder requests by a NEA message in a random activations lot of the best frame that there is data to be read. The wide area reader then, in a data transfer slot, reads the transponder (ETC) information which will include: Tag ID, Plaza ID, Point of Entry and vehicle class. The wide area reader 29 in respect of location MR1 then reads the Smart Card information including Smart Card balance and Smart Card ID.

The wide area reader 29 holds the ETC and the Smart Card information until locator 30 determines that there is a probability higher than the lower threshold (95% certainty) that the transponder is in the wide area zone. The wide area reader 29 then forwards the ETC and Smart Card information to the transaction manager 24. When the locator's certainty that the transponder is in the wide area section has exceeded an upper threshold (we prefer 99.995% certainty) the reader 29 forwards the debit information received from the transaction manager to the tag, using the antenna selected by the transponder algorithm. The Smart Card performs the debit or not and prepares the completion messages. The transaction manager uses the data received to validate the Smart Card, calculate the toll, check the balance and general instructions to debit the Smart Card, or if the balance is not sufficient, to power down the Smart Card and these instructions are transmitted back to the wide area reader. The tag then, via an MRA request, indicates that the data is ready, the reader 29 then performs a read on the transponder to get the completion message from the transponder including the one part of the debit certificate and the signature.

The reader 29 forwards the completion message to the transaction manager 24. The transaction manager 24 reports successful completion (or other result) to all channels IR1–IR9 of the lane based reader so that the lane based reader channels may associate the vehicle in an individual lane with the result, when the vehicle arrives.

The transaction manager 24 pre-calculates the debit certificate before the completion message is received. Upon reception of the transaction completion part details (including the first part of the debit certificate and the signature) from the wide area reader, the transaction manager compares the first part of the debit certificate with the one pre-calculated. If they are not the same, the transaction is rejected. Otherwise, the transaction manager forwards the completion status (including the second half of the pre-calculated debit certificate) to all lane-based readers 34. Upon arrival of the transponder, one of the lane-based readers 34 verifies the second part of the debit certificate by comparing the value with the one received from the transaction manager. If a match is found, the transaction is accepted. Otherwise, the transaction is rejected.

The purpose of transmitting the two parts of the debit certificate separately is to provide a secured token for the lane-based reader. The debit certificate is calculated by using a high level encryption algorithm such as the TRIPLE DES, known to those ordinarily skilled in the art; and a secure encryption key. Based on the same algorithm and key, the second part of the debit certificate is known to both transaction manager and the transponder but is never transmitted over the RF until the valid transponder reaches the lane-based antenna. This prevents a fraud scheme whereby one may capture the data over the RF, and replay the valid transponder ID to the lane-based reader in order to gain access.

The lane controller 36 or other signalling device is then directed to stop or pass the vehicle on the basis of the status report. The corresponding lane based reader channel may also turn on a LED or buzzer to signal to the driver the status of the transaction, the transponder balance or other parameters.

The algorithm and parameters associates with antenna tracking and switching is a follows:

| Parameter | Use | Source |
|---|---|---|
| N | Number of superframes to be used in the selection process | One number for all antennas stored in transponder parameter table. Indexed by a 2 bit field in the FCM |
| Antenna Count | Number of valid frames received on each of the 4 antennas in N | Measured by transponder |
| Threshold | Antenna counts less than this number are not used in the selection algorithm | One number for all antennas stored in parameter table. Indexed by a field in the FCM |
| Antenna Adjustment | This number multiplied by the Antenna Adjustment Multiplier is subtracted from the antenna count to persuade transponders to leave heavily loaded antennas | One number per antenna supplied in FCM |
| Antenna Adjustment Multiplier | Used to decrease or increase the effect of the Antenna Adjustment | One number for all antenna supplied in FCM |
| Hysteresis | This number is added to the current antenna count to prevent excessive switching when the performance of all antennas is similar | One 2 bit number for all antennas supplied in FCM |

Parameters

In the preferred embodiment, the wide area readers and the Smart Card transponders (without Smart Cards) are programmed so that the wide area reader ignores the transponder and it is read for its ETC information at one of the lane based reader channels.

However, it is possible to alternatively program the system so that the wide area reader reads both the ETC and wide area information of the ETC information alone. This will affect the volume of transactions which may be handled.

In one alternative to the roadway arrangement in FIG. 1, vehicles using transponders without a Smart Card may be read in the wide area for the ETC information: Point of Entry, ID, vehicle class at the TDMA. This may, if desired, along with associated equipment, calculate the toll based on the point of entry and either deduct it from a balance on the transponder or send it to other equipment for billing the transponder owner. The fixed equipment may then be programmed to provide the card status, e.g. paid, insufficient balance associated with the ID through a transaction manager or otherwise to the single lane reader for association with the vehicle. The lane based reader channel then operates means which can operate a lane controller to direct the vehicle in accord with the status associated with its transponder ID. Moreover, the appearance of a vehicle at a single lane reader without a transponder or a working transponder may be used by detection means at the lane based reader channels IR1–IR9 to signal a lane controller to take appropriate action, or operate enforcement means.

The wide area readers may be replaced by another time division reader and a different protocol.

Transponder 'status' in relation to toll should indicate 'paid' or otherwise, where 'otherwise' may cover as many defined statuses as desired.

The RF signalling described herein is performed complete with acknowledgments, redundancy checks, encoding as well known in the RF communication art.

The basic idea of upstream reading, toll collection, reporting the debiting of the charge and the account balance by the Smart Card, and also the verification by the transaction manager and the downstream verification by the lane based reader through the transaction manager, provides an arrangement which allows many ways of checking the validity of the transaction, with maximum security.

The transaction manager 24 coordinates the other blocks indicated in FIG. 3. The transaction manager preferably also reports the transactions, with adequate identification, to the plaza host for archival records and for reports to the financial institutions associated with the debiting of Smart Card balances on the one hand and with the replenishment of Smart Card balances on the other.

Typical displays by the Smart Card to the vehicle driver at the ETC read:

yellow light (low balance)

green light (valid account or Smart Card debited)

red light (invalid or no finds).

As will be apparent to those skilled in the art in the light of the foregoing disclosure, many alterations and modifications are possible in the practice of this invention without departing from the spirit or scope thereof. The foregoing description is of the preferred embodiments by way of example only, and is not to limit the scope of the invention.

What is claimed is:

1. In a toll collection environment having an upstream roadway wide area which leads to a downstream plurality of individual lanes, apparatus for collection vehicle tolls, comprising:

a transponder for location in a vehicle entering the upstream roadway wide area, the transponder including means for recording and debiting a toll from an account balance;

at least one first reader adapted to communicate with said transponder in said wide area;

at least one second reader adapted to communicate with said transponder in an individual lane downstream from said wide area;

transaction means connected to said first reader responsive to communication with said transponder to calculate a toll associated with said transponder and to obtain identification information associated with said transponder, and to instruct said transponder through said first reader to debit the toll from the account balance;

means for transmitting toll payment status information from said transponder to the first reader;

means for transmitting said identification information from said first reader to said second reader upon receipt of successful toll payment status information by the first reader; and means associated with the second reader for signalling the payment of a toll upon receipt by said second reader of the same identification information from a transponder attached to a vehicle as is received from the first reader.

2. Apparatus as claimed in claim 1 wherein said transponder includes a Smart Card for recording and debiting the toll from the account balance.

3. Apparatus as claimed in claim 2 wherein the transmission and reception frequencies of said first reader are different.

4. Apparatus as claimed in claim 2 wherein said first reader and transponder have a first communications protocol whereby information from said transponder causes said transaction means to calculate said toll, obtain said transponder identification information and transmit instructions to said transponder to debit payment and create a certificate of payment and transmit same to the first reader, and means associated with said first reader to transmit said identification information to said second reader independently of said transponder, said second reader having a second communications protocol with said transponder, responsive to arrival of said transponder in an individual lane to obtain transponder identification information from such transponder.

5. Apparatus as claimed in claim 4 wherein the transmission and reception frequencies of said second reader are different.

6. Apparatus as claimed in claim 4 wherein the TDMA protocol is used as said first communications protocol.

7. Apparatus as claimed in claim 1 wherein said first reader and transaction means provides status information to the second reader as to payment or non-payment of the toll.

8. Apparatus as claimed in claim 1 and further comprising multiple antenna channels corresponding to said first reader and wherein said transponder is programmed to determine which of the multiple antennas provides the best consistency of received communication signals.

9. Apparatus as claimed in claim 8 wherein said at least one first reader has multiple channels each associated with a different antenna channel and said transponder is equipped to determine which channel it is received most clearly.

10. Apparatus as claimed in claim 9 wherein said antenna signals are synchronized with each other and control such transponder for synchronism with the antenna signals.

11. Apparatus as claimed in claim 1 and further comprising:

said first reader having different upstream channels for RF communications with a transponder in said upstream area;

said second reader having different downstream channels for RF communications with a transponder in any one of said lanes; and means for synchronizing broadcasts on said first and second separate channels to avoid time overlap of signals on said upstream and/or downstream channels.

12. Apparatus as claimed in claim 11 and further comprising a plurality of said second readers, and wherein said second readers are synchronized with each other.

13. Apparatus as claimed in claim 12 where said second readers are also synchronized with said first reader channel.

14. Apparatus claimed in claim 1, further comprising multiple antennas each transmitting a plurality of frames, and antenna selection means for counting a number of frames validly received by said transponder from each antenna and for selecting the antenna having the greatest number of validly received frames.

15. A Apparatus claimed in claim 14, wherein said antenna selection means includes means for adjusting the number of frames validly received from an antenna based upon adjusting instructions received from said first reader.

16. Apparatus for collecting highway tolls from vehicles having transponders, comprising:

a transponder with an optional Smart Card wherein said transponder without such a Smart Card has identification (ID) information, said transponder including means for calculating a toll, and wherein the transponder having a Smart Card has the additional capacity of debiting a recorded account on said Smart Card;

a lane based reader;

a wide area reader upstream therefrom sharing a first RF communication protocol with the transponder having a Smart Card, the wide area reader having determining means associated therewith to provide to the transponder the amount of said toll associated with the ID and to receive a status receipt from said transponder reflecting receipt for payment therefrom means for communication between said wide area reader and said lane based readers independent of said transponders; and means for associating the status and ID with the vehicle carrying such transponder at said lane based reader.

17. Apparatus as claimed in claim 16 wherein said lane based reader is responsive to a paid status signal from said transponder respectively to signal further action of said vehicle.

18. Apparatus claimed in claim 16, wherein said wide area reader includes multiple antennas each transmitting a plurality of frames, and wherein said transponder includes antenna selection means for counting a number of frames validly received by said transponder from each antenna and for selecting the antenna having the greatest number of validly received frames.

19. Apparatus claimed in claim 18, wherein said antenna selection means includes means for adjusting the number of frames validly received from an antenna based upon adjusting instructions received from said wide reader.

20. On a closed toll highway, using RF for toll calculations, for vehicles with Smart Card equipped transponders, apparatus comprising:

upstream means having a first reader to obtain entry information and transponder ID from a transponder under a first protocol to actuate and report a status of toll payment associated with the transponder ID by amounts recorded on said Smart Card under said first protocol; and downstream means having a second reader to confirm a class of vehicle, transponder ID, and status of toll payment under a second protocol, wherein said upstream means includes communication means for communicating the class of vehicle, transponder ID, and status of toll payment from said first reader to said second reader.

21. A toll collection system for a roadway comprising:

an upstream reader adjacent to said roadway designed to enter into RF communication with a transponder equipped with a Smart Card;

a downstream reader adjacent to said roadway disposed to enter into RE communication with such transponder;

a transaction manager connected for RF communication with both said upstream and said downstream readers;

said transaction manager adapted to cooperate with the upstream reader to calculate a toll upon communication of the upstream reader with the transponder;

said transaction manager adapted to pre-calculate a first and second part message responsive to a toll calculation;

said transponder having means to calculate and send to the upstream reader a similar first and second part message responsive to the deduction of a toll;

said transaction manager adapted to compare said transaction manager and said transponder first message parts; and said downstream reader adapted to compare said transaction manager and said transponder second message parts.

22. Apparatus claimed in claim 21, wherein said upstream reader includes multiple antennas each transmitting a plurality of frames, and wherein said transponder includes antenna selection means for counting a number of frames validly received by said transponder from each antenna and for selecting the antenna having the greatest number of validly received frames.

23. Apparatus claimed in claim 22, wherein said antenna selection means includes means for adjusting the number of frames validly received from an antenna based upon adjusting instructions received from said upstream reader.

* * * * *